United States Patent [19]

Little

[11] Patent Number: 4,921,421

[45] Date of Patent: May 1, 1990

[54] CANDELABRUM

[76] Inventor: Carol E. Little, P.O. Box 758, Plains, Kans. 67869

[21] Appl. No.: 418,236

[22] Filed: Oct. 6, 1989

[51] Int. Cl.[5] ..... F23D 3/16

[52] U.S. Cl. ..... 431/295; D26/13; D26/23; 362/209

[58] Field of Search ..... 431/295, 296; 362/161, 362/162, 190, 209, 249, 806; D26/13, 14, 15, 23

[56] References Cited

U.S. PATENT DOCUMENTS

| | | | |
|---|---|---|---|
| D. 44,252 | 6/1913 | Newton et al. . | |
| D. 64,218 | 8/1951 | Bussey . | |
| 481,225 | 8/1892 | Daleiden | 431/295 |
| 591,557 | 10/1897 | Markowsky . | |
| 619,821 | 9/1898 | Nehr . | |
| 637,671 | 11/1899 | Schaffer | 431/295 |
| 859,707 | 7/1907 | Van Guelpson | 431/295 |
| 904,111 | 11/1908 | Anderson | 431/295 |
| 1,204,134 | 11/1916 | Connolly . | |
| 3,091,106 | 5/1963 | Crouch . | |

*Primary Examiner*—Carl D. Price

*Attorney, Agent, or Firm*—A. Robert Theibault

[57] ABSTRACT

A candelabra made of flat steel straps bent into a semi-circular form the other free ends of which are bent toward one another forming a candle ledge having candle cups secured therealong. Additional candle cups may be added to the free ends of the steel straps by using extension straps. The structure is supported by a telescopic support.

6 Claims, 5 Drawing Sheets

CANDELABRUM

TECHNICAL FIELD

My invention relates to candelabras of the was candle or electrical type to be used in churches or wedding chapels permitting the blending of candles with wedding symbols such as hearts and rings.

BACKGROUND ART

Heretofore many forms of candelabras have been proposed for both church and wedding chapel use. The closest art known to me prior to this application are the following U.S. letters patent:

No. 591,557, granted Oct. 12, 1897 to MARKOWSKY;
No. 610,821, granted Sept. 13, 1898 to NEHR;
No. 637,671, granted Nov. 21, 1899 to SCHAFFER;
Des. 44,352, granted June 24, 1913, to NEWTON, etal;
No. 1,204,134, granted Nov. 7, 1916, to CONNOLLY;
Des. 164,218, granted Aug. 14, 1951, to BUSSEY;
No. 3,091,106, granted May 28, 1963, to CROUCH.

DISCLOSURE OF THE INVENTION

In accordance with my invention I provide a candelabra made up of a first open end flat steel strap bent into a semicircular form the outer free ends of which are bent toward one another to form a candle ledge support. A pair of flat steel straps are secured at one end to the inside of the semicircular flat strap as by welding and the free ends of semicircular steel strap bent toward one another are welded or otherwise secured to the flat steel straps. The semicircular flat steel strap, its bent inwardly ends as well as the pair of flat steel straps welded to the inside of the semicircular flat steel strap have uniformly spaced cross opening at evenly spaced distances through which ivy, ribbon decorations or electrical wiring may be laced if electric candles are employed.

The structure of the semicircular flat steel strap and its ends forming the candle support members is raisable or lowerable by a telescopic support the outer member of which is secured to a mount stand and the inner member of which is secured to the bottom of the semicircular flat steel strap and passes through a collar having a threaded bolt passing therethrough to adjust the height of the semicircular candle support above the floor upon which the candelabra is set.

The candle ledge supports have candle cups secured therealong into which either electric or wax candles may be inserted.

Additional candles may be added to the free ends of flat steel straps bent toward one another forming a candle ledge support having candle cups secured therealong by using extension straps having a candle cup loop on one end adapted to pass over the candle cups secured to the candle ledge support on one end and having a candle cup on its other end so that twice the number of candles may be placed on the candelabra.

Combinations of hearts and rings may be added to the semicircular flat steel strap and candle support ledges and attachment tabs are provided for bolting selectively a heart or hearts, a ring or rings to the semicircular flat steel strap and candle support ledges as shown in FIGS. 2, 8, 11, 12 or 13. Both the hearts and rings are made up of flat steel strap welded into a closed germetric structure. The geometric structures are secured together through tabs secured in place by bolts and nuts and rendered not viewable by the passing of decorative material about the flat strap structure which not only decorates the steel strip but hides the connections.

The apex of the two flat steel straps may be provided with a flat plate having an upstanding pointed projection to impail either a floral piece or a large candle.

DESCRIPTION OF THE FIGURES OF DRAWINGS

DESCRIPTION OF THE PREFERRED EMBODIMENTS OF MY INVENTION

Figures 1, 1A, 1B:
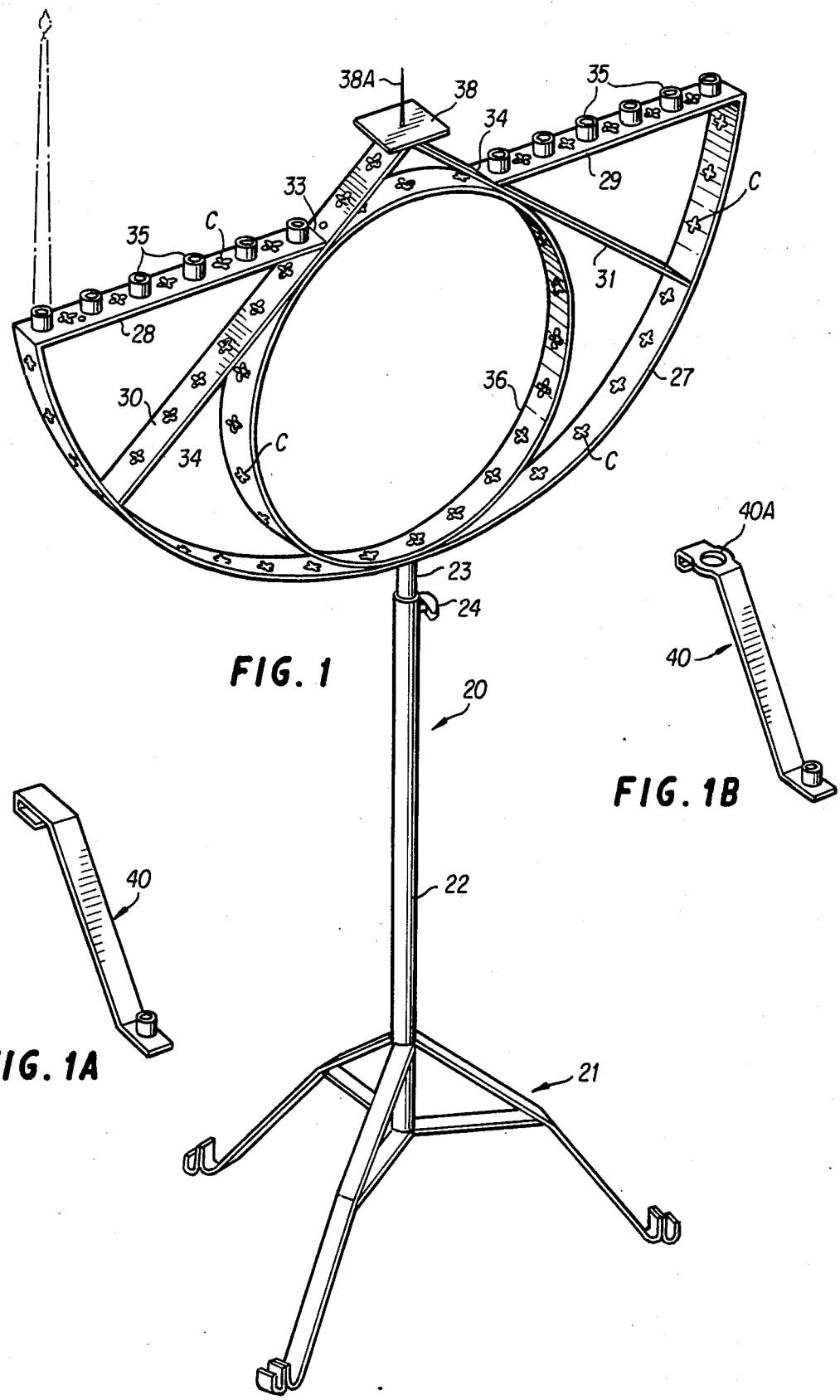
FIG. 1 is a perspective view of a candelabra constructed in accordance with a wedding ring motif embodying my invention.
FIG. 1A is a perspective view of a supplemental candle strap support for adding additional candles which locks over the flat candle ledge support between the semicircular portion of the first steel strap and the second steel strap.
FIG. 1B is a perspective view of one form of strap for adding additional candles to the candle support ledge which locks over the support ledge and candle cup holder secured to the support ledge.

Referring now to FIGS. 1 through 4 of the drawings 20 designates the central support for my candelabra having a base 21 comprising an upright hollow standard 22 which together with a rod 23 forms an adjustable support which may be raised, lowered and locked in place by a threaded bolt 24 passing through a threaded hollow support standard 22. A locking tab 25 is secured on the exterior end of threaded bolt 24 to cause the bolt 24 to bear against and lock the rod 23 relative to the hollow standard 22 of base 21. Either three or four legs 26 are positioned evenly circumferentially about the base 21 to give stability thereto.

The upper end of rod 23 has connected thereto the upper candle support and decorative support of my candelabra.

Figure 2:
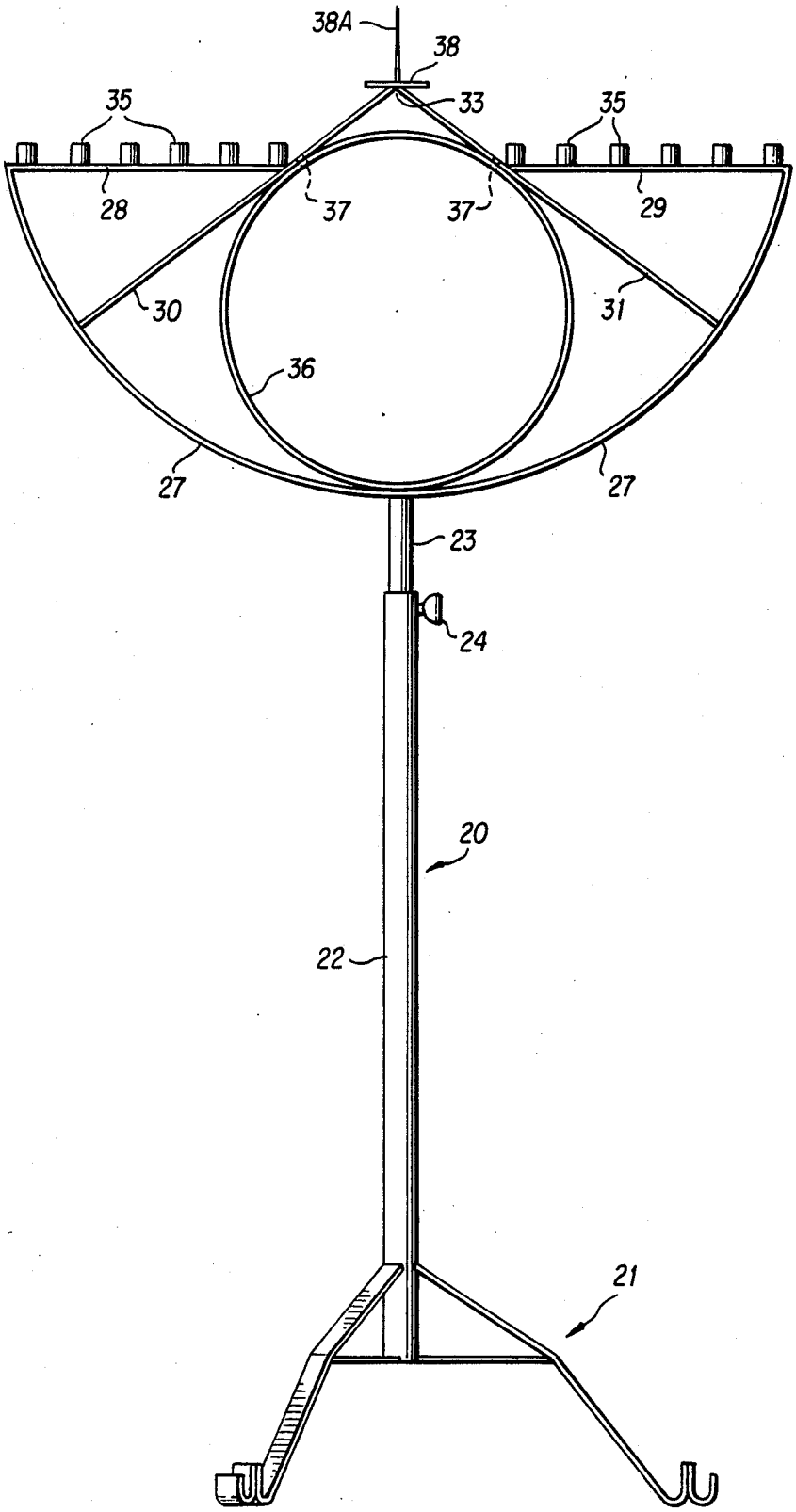
FIG. 2 is a front elevational view of the embodiment of FIG. 1 in accordance with my invention.
Figure 3:
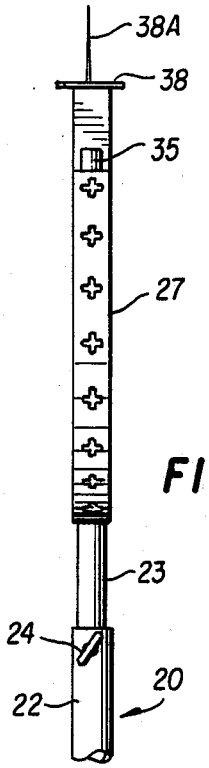
FIG. 3 is an end elevational view of the candelabra of FIG. 1 taken from the left hand end thereof.

Referring now to FIGS. 1 and 2 the upper candelabra structure comprises a first open end steel strap 27 bent into substantially a semicircular form of candle support. The free ends 28, 29 of strap 27 are bent inwardly toward one another and all three portions 27, 28 and 29 have perforations in the form of cross openings C therethrough at evenly spaced distances. A pair of second steel straps 30, 31 each have one end welded to the inside of the first steel strap 27 as at 32, 33. These straps 30, 31, like strap 27 has perforated cross openings 34 evenly spaced through which decorations or wiring may be wound and threaded. The upper ends of straps 30, 31 are welded and form the apex 33 of an open bottomed triangle. The inwardly bent ends 28, 29 of strap 27 are welded to the out side of straps 30, 31 at 33, 34. The inwardly bent ends 28, 29 form a support ledge for candle cups 35 which are evenly spaced along and secured thereto.

As best seen in FIGS. 1 and 2 a flat perforated strip ring in the form resembling a single wedding ring 36 is secured with either a bolt and nut or projections 37 on the ring mating with a complemental opening or openings through straps 30, 31. Welded to the apex 33 of strap sides 30, 31 is a flat base plate 38 having a pointed projection 38A upstanding therefrom upon which may be impailed either a bouquet or candle.

Figure 5:
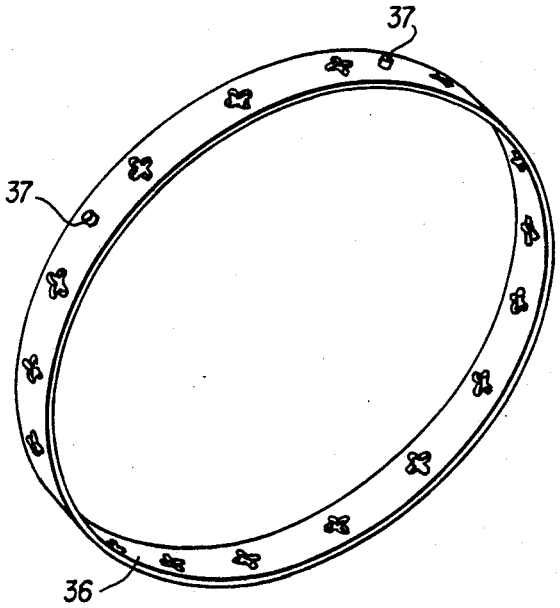
FIG. 5 is a perspective view of one form of wedding ring employed with the candelabra of FIGS. 1, 2 and 3 of my invention.
Figure 6:
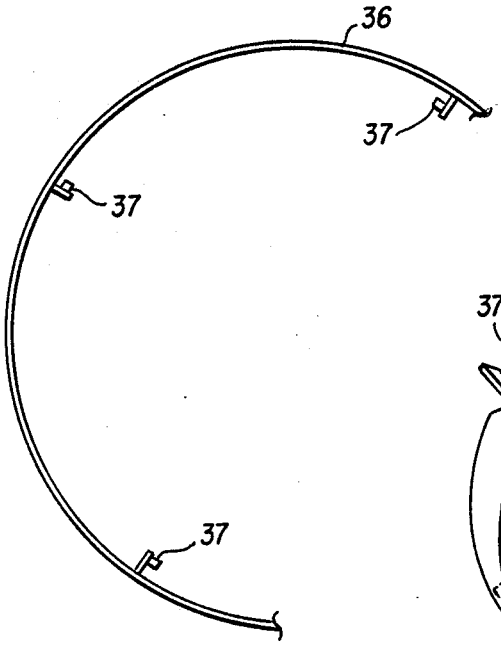
FIG. 6 is a fragmentary end view of FIG. 5 taken at an enlarged scale.
Figure 7:
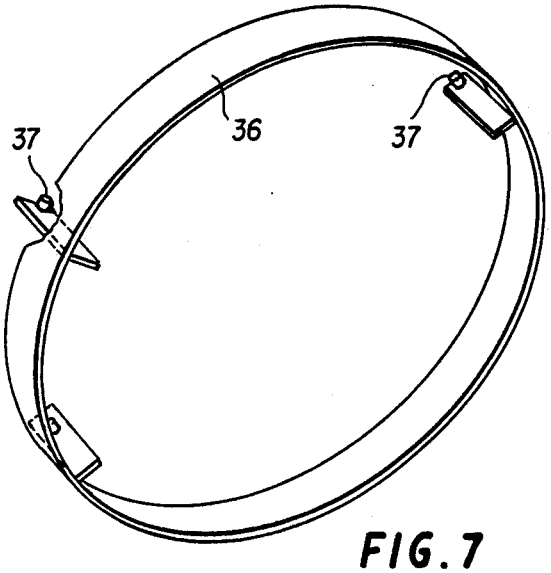
FIG. 7 is a perspective view of the wedding ring of FIG. 5 having a portion broken away showing the mounting tabs for two wedding rings.
Figure 4:
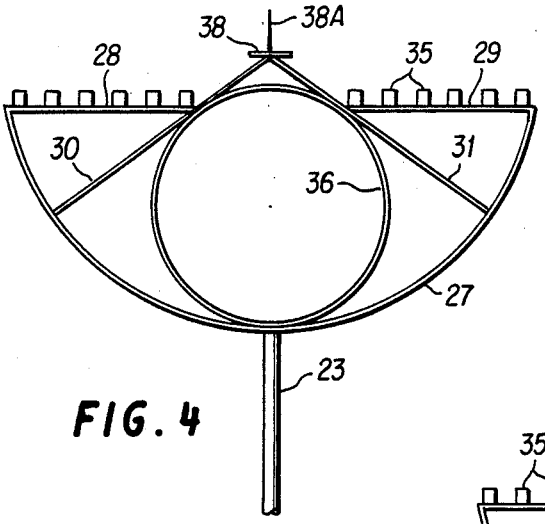
FIG. 4 is a front elevational view of the upper candle support portion of the candelabra of FIG. 2 showing single wedding ring motif.
Figure 13:
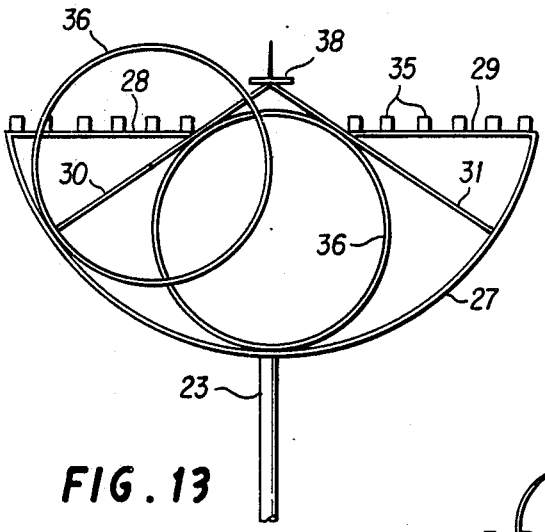
FIG. 13 is a front elevational view of a double wedding ring motif employed with the upper candle support structure of my invention.
Figure 8:
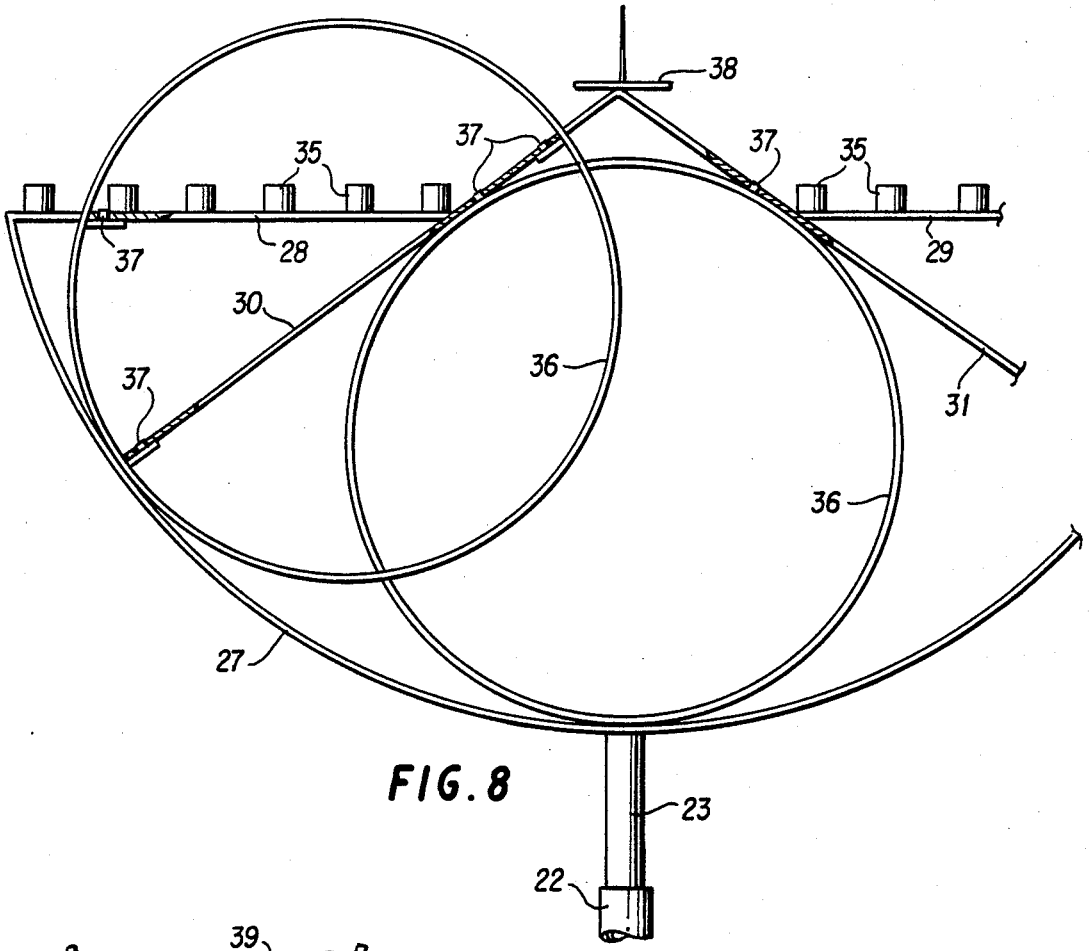
FIG. 8 is an enlarged front elevational view of double ring motif shown in FIG. 13

When more than one ring 36 is employed as in FIGS. 8 and 13 end tab openings and projections 37 as shown in FIGS. 5, 6 and 7 may be employed.

Figure 11:
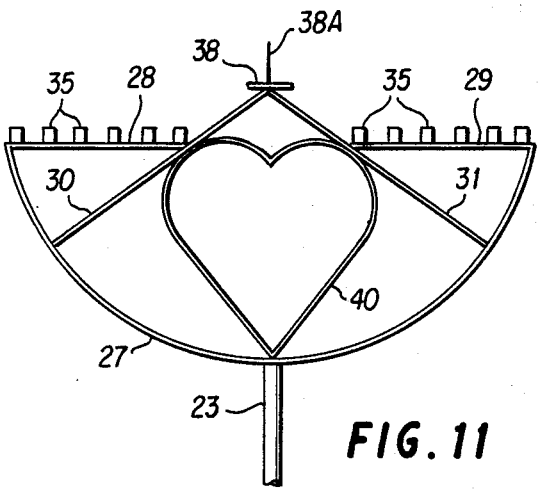
FIG. 11 is a front elevational view of the candle support structure of a single heart motif upper candle support structure of my invention.
Figure 12:
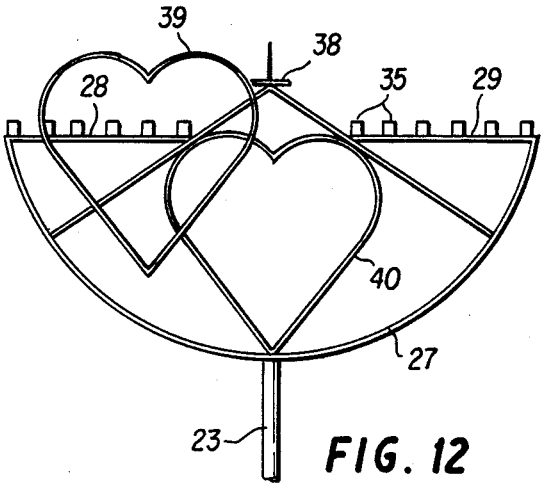
FIG. 12 is a front elevational view of a two heart structure motif employed with the upper portion of my invention.
Figure 9:
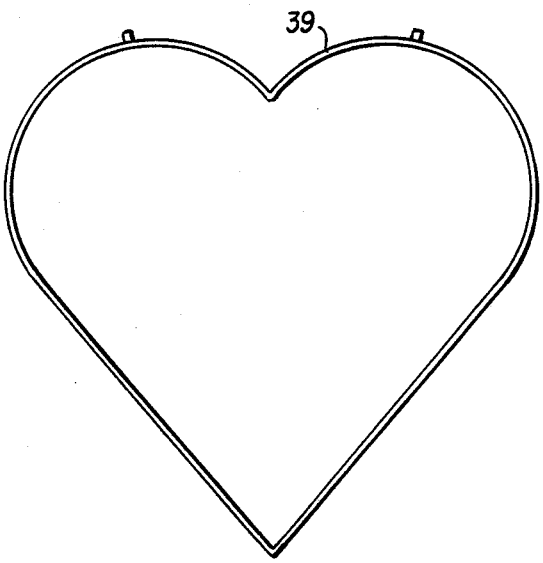
FIG. 9 is a front elevational view of a single heart employed as shown in FIG. 11.
Figure 10:
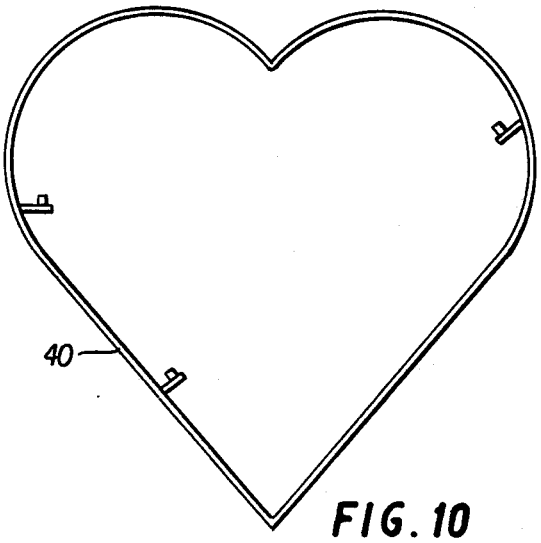
FIG. 10 is a front elevational view of a single heart to be joined with the heart of FIG. 9 as shown in FIG. 12.

The heart as shown in FIGS. 11 and 12 may be employed in lieu of the wedding ring by employing the hearts 39, 40 made of strap metal as shown in FIGS. 9 and 10.

The rings and hearts may be spray painted either white or gold and the same applies to FIGS. 1 and 2.

Additional candles may be added to the candelabra of FIGS. 1 and 2 by using the strap of FIG. 1A to lock over the candle ledge supports 28, 29 between the candle cups 35 or to provide an opening 40A in the upper portion of the strap to pass over and peripherally engage the candle cups 35.

What I claim is:

1. A candelabra comprising a first open end steel strap bent into a semicircular form to form a candle support, the upper free ends of said first steel strap being bent toward one another to form a candle support ledge, a pair of second steel straps each of which is secured at one end to the inside of said first semicircular formed steel strap and being secured together at their other ends to form an inverted open based triangle, one of a heart and ring means formed from closed perforated flat steel straps connectable to said first and second steel straps, mount means for connecting said heart and ring means to said first and second steel straps forming the candelabra, a vertically adjustable slidable support having an inner member and an outer member, connected to a base support for raising and lowering the candle support ledges, the inner member of which is secured to the base of said semicircular steel strap, the free ends of the bent portions of said first open ended steel strap being welded to the upper portions of said inverted open based triangle, said first steel strap ends being bent toward one another and being secured to the outside of said second steel straps forming the inverted open based triangle, candle cup supports secured at spaced distances along the upper surfaces of said candle support ledges of said first steel strap which are bent toward one another, said first and second steel straps having cross openings therethrough at evenly spaced distances, said heart and ring mount means carried by said first and second steel straps, at least one of said ring or heart being formed of flat steel straps having uniformly spaced cross openings therethrough and being secured to said mount means, and said a support base for said candelabra being secured to the outside member of said vertical adjustable slidable support.

2. A candelabra as claimed in claim 1 wherein the portions of said first and second steel straps secured to one another are secured by welding.

3. A candelabra as claimed in claim 1 wherein said heart and ring mount means are perforated tabs for bolting selectively a heart or ring to said first and second steel straps.

4. A candelabra as claimed in claim 1 further comprising additional candle support means receivable over the candle cup supports for increasing the number of candles supported by the candelabra.

5. A candelabra as claimed in claim 1 wherein said support base has at least three evenly spaced apart feet circumferentially spaced about said vertically adjustable slidable support to impart stability to the candelabra.

6. A candelabra as claimed in claim 1 further comprising an extension candle support strap having an opening through one end receivable over the candle cups on the candle support ledge of said first steel strap and a candle support ledge on the other end of said candle support strap and having a candle cup thereon to add an extra candle adjacent to but spaced from each candle on said candle support ledge.

* * * * *